US005337837A

United States Patent [19]

Wentworth et al.

[11] Patent Number: 5,337,837

[45] Date of Patent: Aug. 16, 1994

[54] DUAL-DIAMETER PNEUMATIC GROUND PIERCING TOOL

[75] Inventors: Steven W. Wentworth, Brookfield; Robert F. Crane, Summit; Jon A. Haas; Payce Reynolds, both of Oconomowoc, all of Wis.

[73] Assignee: Earth Tool Corporation, Oconomowoc, Wis.

[21] Appl. No.: 79,095

[22] Filed: Jun. 17, 1993

[51] Int. Cl.[5] ..... E21B 4/14

[52] U.S. Cl. ..... 175/19; 173/91; 173/126; 175/296

[58] Field of Search ..... 175/19, 296, 92; 173/91, 126

[56] References Cited

U.S. PATENT DOCUMENTS

| | | | |
|---|---|---|---|
| 3,137,483 | 6/1964 | Zinkiewicz . | |
| 3,407,884 | 10/1968 | Zygmunt | 173/91 |
| 3,410,354 | 11/1968 | Sudnishnikov et al. | 173/125 |
| 3,674,099 | 7/1972 | Kostylev et al. | 175/20 |
| 3,685,597 | 8/1972 | Kostylev et al. | 175/19 |
| 3,730,283 | 5/1973 | Kostylev et al. | 175/53 |
| 3,756,328 | 9/1973 | Sudnishnikov et al. | 173/91 |
| 3,865,200 | 2/1975 | Schmidt | 175/19 |
| 3,970,157 | 7/1976 | Schmidt | 175/22 |
| 4,070,948 | 1/1978 | Tkach et al. | 91/234 |
| 4,100,979 | 7/1978 | Schmidt | 175/19 |
| 4,100,980 | 7/1978 | Tenne | 175/19 |
| 4,809,789 | 3/1989 | MacFarlane | 173/91 |
| 5,025,868 | 6/1991 | Wentworth et al. | 173/91 |
| 5,199,151 | 4/1993 | Wentworth et al. | 29/437 |

FOREIGN PATENT DOCUMENTS

| | | | |
|---|---|---|---|
| 325715 | 8/1989 | European Pat. Off. | 175/92 |
| 484839 | 5/1992 | European Pat. Off. | 175/296 |

OTHER PUBLICATIONS

Brochure entitled: Pierce-Airrow, an Exciting Product in a Boring Business, p. 5 (undated).

*Primary Examiner*—Hoang C. Dang
*Attorney, Agent, or Firm*—Foley & Lardner

[57] ABSTRACT

The weight of a pneumatic ground piercing tool of the type having a stepped air inlet is reduced and tool power increased by providing the tool body with a dual diameter. The tubular tool body has a front section and a rear section which has a greater inner and outer diameter than the front section, thereby reducing overall tool weight. In a preferred embodiment, the rear end portion of the striker likewise has a greater outer diameter than the front end portion thereof. The bearing of the front end portion of the striker remains in sliding contact with the interior of the front body section during tool operation, and the bearing of the rear end portion of the striker likewise remains in sliding contact with the interior of the rear body section. In this manner, the power of the tool is enhanced because the tool has less weight and the air distributing mechanism, located in the rear body section, is the same size as in a conventional tool wherein the entire body has a uniform diameter.

16 Claims, 1 Drawing Sheet

DUAL-DIAMETER PNEUMATIC GROUND PIERCING TOOL

TECHNICAL FIELD

This invention relates to pneumatic impact tools, particularly to self-propelled ground piercing tools.

BACKGROUND OF THE INVENTION

Self-propelled pneumatic tools for making small diameter holes through soil are well known. Such tools are used to form holes for pipes or cables beneath roadways without need for digging a trench across the roadway. These tools include, as general components, a torpedo-shaped body having a tapered nose and an open rear end, an air supply hose which enters the rear of the tool and connects it to an air compressor, a piston or striker disposed for reciprocal movement within the tool, and an air distributing mechanism for causing the striker to move rapidly back and forth. The striker impacts against the front wall (anvil) of the interior of the tool body, causing the tool to move violently forward into the soil. The friction between the outside of the tool body and the surrounding soil tends to hold the tool in place as the striker moves back for another blow, resulting in incremental forward movement through the soil. Exhaust passages are provided in the tail assembly of the tool to allow spent compressed air to escape into the atmosphere.

Most impact boring tools of this type have a valveless air distributing mechanism which utilizes a stepped air inlet. See, for example, Sudnishnikov et al. U.S. Pat. No 3,410,354, issued Nov. 12, 1968. The step of the air inlet is in sliding, sealing contact with a tubular cavity in the rear of the striker. The striker has radial passages through the tubular wall surrounding this cavity, and an outer bearing surface of enlarged diameter at the rear end of the striker. This bearing surface engages the inner surface of the tool body.

Air fed into the tool enters the cavity in the striker through the air inlet, creating a constant pressure which urges the striker forward. When the striker has moved forward sufficiently far so that the radial passages clear the front end of the step, compressed air enters the space between the striker and the body ahead of the bearing surface at the rear of the striker. Since the cross-sectional area of the front of the striker is greater than the cross-sectional area of its rear cavity, the net force exerted by the compressed air now urges the striker backwards instead of forwards. This generally happens just after the striker has imparted a blow to the anvil at the front of the tool.

As the striker moves rearward, the radial holes pass back over the step and isolate the front chamber of the tool from the compressed air supply. The momentum of the striker carries it rearward until the radial holes clear the rear end of the step. At this time the pressure in the front chamber is relieved because the air therein rushes out through the radial holes and passes through exhaust passages at the rear of the tool into the atmosphere. The pressure in the rear cavity of the striker, which defines a constant pressure chamber together with the stepped air inlet, then causes the striker to move forwardly again, and the cycle is repeated.

In some prior tools, the air inlet includes a separate air inlet pipe, which is secured to the body by a radial flange having exhaust holes therethrough, and a stepped bushing connected to the air inlet pipe by a flexible hose. See Sudnishnikov et al. U.S. Pat. No. 3,410,354, issued Nov. 12, 1968. These tools have been made reversible by providing a threaded connection between the air inlet sleeve and the surrounding structure which holds the air inlet concentric with the tool body. See, for example, Sudnishnikov et al. U.S. Pat. No. 3,756,328, issued Nov. 12, 1968. The threaded connection allows the operator to rotate the air supply hose and thereby displace the stepped air inlet rearward relative to the striker. Since the stroke of the striker is determined by the position of the step, i.e., the positions at which the radial holes are uncovered, rearward displacement of the stepped air inlet causes the striker to hit against the tail nut at the rear of the tool instead of the front anvil, driving the tool rearward out of the hole.

Wentworth et al. U.S. Pat. No. 5,025,868 describes a ground-piercing tool having an improved form of screw-reverse mechanism, a unique striker having annular bearing rings at each end, and a removable, axially clamp-loaded end cap assembly that facilitates repair and reassembly of the tool. Wentworth et al. U.S. Pat. No. 5,199,151 describes a tool of similar construction wherein the tool body is made by rotary swaging rather than by machining a solid metal bar.

Ground-piercing tools of this type have generally had a uniform body diameter. One exception is Schmidt U.S. Pat. No. 3,865,200, which discloses a tail nut having a slightly enlarged diameter. See also a brochure entitled PIERCE-AIRROW, AN EXCITING PRODUCT IN A BORING BUSINESS, page 5 (undated) Zinkiewicz U.S. Pat. No. 3,137,483 and Zygmunt U.S. Pat. No. 3,407,884 show tool bodies with varying internal and external shapes, including a front section having an outer surface that tapers gradually to a point. However, these tools have a va lye structure and a separate front pressure chamber different from the later tools based on the stepped air inlet design.

The tool body of the foregoing known tools having a stepped air inlet is generally made from a solid steel bar of uniform diameter which is drilled out to form the tubular tool body. The tool body is the single heaviest component of the tool, which as a whole weighs anywhere from 140 to 190 pounds or more for tool diameters in the range from 4 to 5.5 inches. The tools are commonly lifted during use by one or two men, sometimes resulting in back injuries.

One way to make such injuries less likely is to use a frustoconical expander attachment on the front or rear of a smaller diameter tool, in a manner well known in the art. See, for example, Schmidt U.S. Pat. No. 3,970,157, Tkach et al. U.S. Pat. No. 4,070,948 and Kostylev et al U.S Pat. Nos. 3,685,597, 3,674,099, and 3,730,283. This approach works under the right circumstances, but requires that the bore be run twice, the first time with the smaller diameter tool by itself, and the second time with the tool equipped with the expander. This greatly increases the time needed to make the hole, and the expander may not work in some soils due to its limited surface area. A need remains for a self-propelled tool of the type described in the foregoing patents which is lighter in weight, yet still capable of boring holes of the same diameter as full-size tools presently available.

SUMMARY OF THE INVENTION

The present invention provides a pneumatic ground piercing tool of the type having a stepped air inlet as described above wherein the weight of the tool is reduced and the tool power is increased by providing the tool body with a dual outer diameter, preferably both a dual inner and outer body diameter. Such a tool generally includes an elongated hollow body having a front nose and a rear opening. A striker is disposed for reciprocation within an internal chamber of the body to impart impacts thereto for driving the body through the ground. The striker has a rearwardly opening recess and a rear radial passage through a wall enclosing the recess, a front portion having a front bearing thereon for sliding contact with the inner surface of the body within the internal chamber and passages permitting flow of pressure fluid to a front, variable-volume pressure chamber ahead of the striker, and a rear portion having a rear bearing thereon rearwardly of the radial passage for sliding contact with the inner surface of the tool body within the internal chamber. A stepped air inlet conduit cooperates with the striker within the internal chamber of the body to reciprocate the striker and impart blows to a front end wall of the internal chamber under the action of a pressure fluid fed into the rear recess in the striker. This is followed by reverse movement of the striker when the rear radial passage moves past a front edge of the step of the stepped air inlet conduit, and exhaust of compressed air when the rear radial passage moves past a rear edge of the step of the stepped air inlet conduit. A tail assembly mounted in the rear opening of the body secures the striker and air inlet conduit in the body.

According to one aspect of the invention, the tubular body has a front section and a rear section having a greater inner diameter and greater outer diameter than the front section. The rear portion of the striker has a greater maximum outer diameter than the front portion thereof, such that the front bearing remains in sliding contact with the inner surface of the front section of the body during tool operation, and the rear bearing remains in sliding contact with the inner surface of the rear section of the body during tool operation.

In a preferred embodiment, the front body section comprises at least about one-fifth of the total length of the tool body, and the rear portion of the striker, over at least a part of the length thereof radially outwardly of the rearwardly opening recess therein, has a diameter greater than the maximum diameter of the front portion of the striker, the difference therebetween being approximately the same as the difference between the outer diameter of the rear body section and the outer diameter of the front body section. Each of the front and rear body sections have substantially uniform inner diameters over respective ranges of positions at which the front and rear bearings engage the associated inner surfaces within the internal chamber. The foregoing features enhance the power of the tool while decreasing its weight, making it easier to handle.

Other objects, features and advantages of the present invention will become apparent from the following detailed description. It should be understood, however, that the detailed description is given by way of illustration only, since various changes and modifications within the spirit and scope of the invention will become apparent to those skilled in the art.

BRIEF DESCRIPTION OF THE DRAWING

The invention will hereafter be described with reference to the accompanying drawing, wherein like numerals denote like elements, and.

DETAILED DESCRIPTION OF PREFERRED EMBODIMENTS

Figure 1:
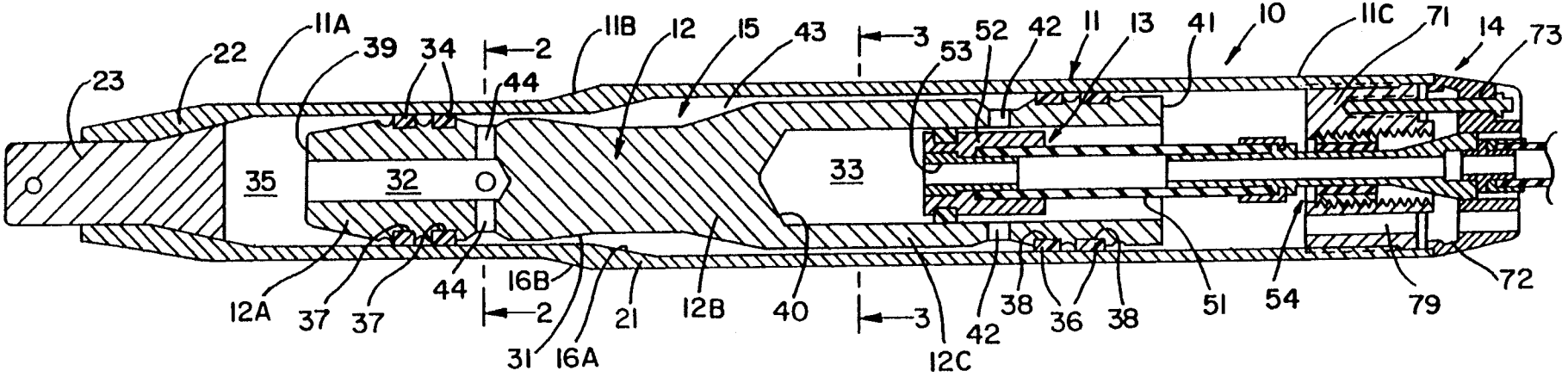
FIG. 1 is a lengthwise sectional view of an impact boring tool according to the invention.
Figure 3:
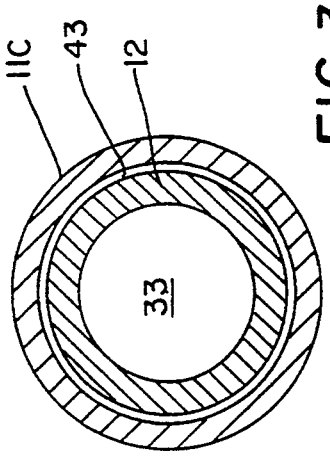
FIG. 3 is a cross-sectional view taken along the line 3—3 in FIG. 1.
Figure 2:
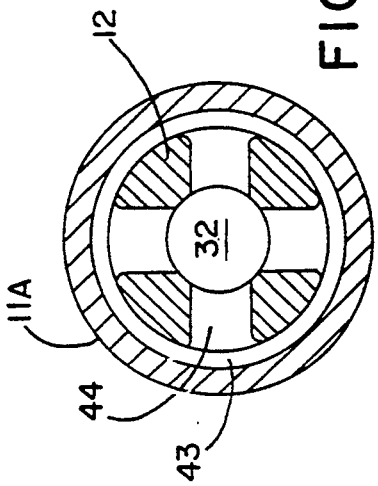
FIG. 2 is a cross-sectional view taken along the line 2—2 in FIG. 1.

Referring now to FIG. 1, a pneumatic ground piercing tool 10 according to the invention includes, as main components, a tool body 11, a striker 12 for impacting against the interior of body 11 to drive the tool forward, a stepped air inlet conduit 13 which cooperates with striker 12 for forming an air distributing mechanism for supplying compressed air to reciprocate striker 12, and a tail assembly 14 which allows exhaust air to escape from the tool, secures conduit 13 to body 11, and provides a threaded connection to allow reverse operation. Stepped air inlet conduit 13 includes a flexible hose 51, a tubular bushing 52 fitted with an inner locking nut 53, and a forward-reverse adjuster screw mechanism 54. Tail assembly 14 includes a tail nut (rear anvil) 71 and an end cap (cone) 72 secured together by bolts 73. Nut 71 is threadedly secured in a rear opening of the tool body 11 and has exhaust passages 79 therein. Except as described below, the foregoing components function generally in the same manner as described in Wentworth et al. U.S. Pat. No. 5,025,868, issued Jun. 25, 1991, the entire contents of which are incorporated by reference herein.

Tool body 11 comprises a cylindrical hollow housing 21 having a tapered nose 22 ending in an anvil 23. Nose 22 can be made by swaging a front end portion of a tubular steel pipe against a frontwardly tapering, generally frustoconical forming anvil, or by machining. Unlike prior tools, tool body 11 further has a front section 11A, a rear section 11C of greater diameter than front section 11A, and a tapered, frustoconical midsection 11B that makes the transition from the larger diameter section 11C to the smaller diameter section 11A. Midsection 11B could comprise a radial step or shoulder, but a tapered surface provides better movement through the ground and makes the tool body easier to machine.

The inner surfaces of sections 11A, 11B and 11C define an internal chamber 15 in which striker 12 is housed, and are configured in the same manner as the outer surfaces thereof described above, except that the inner tapered surface 16A of midsection 11B is rearwardly offset from the outer tapered surface 16B thereof, strengthening the tool at the juncture between the front and rear sections. In particular, midsection 11B is preferably at least about 50% thicker than sections 11A, 11C because bending of the tool body tends to occur at midsection 11B, which bending might otherwise fracture the tool body. The thickness of body 11 is preferably in the range from about 0.2 to 0.8 inch for tool diameters ranging from 2 to 6 inches, with small diameter tools tending to have thinner bodies.

Striker 12 is disposed for sliding, back-and-forth movement inside chamber 15 of tool body 11 forwardly of conduit 13 and tail assembly 14. Striker 12 comprises a generally cylindrical rod 31 having frontwardly and rearward opening blind holes (recesses) 32, 33 respectively therein. Pairs of plastic, front and rear annular seal bearings 34, 36 are disposed in corresponding annular grooves 37, 38 in the outer periphery of rod 31 for supporting striker 12 for movement along the inner surface of body 11. Annular front impact surface 39 impacts against anvil 23 when the tool is in forward mode, and an annular rear impact surface 41 impacts against nut 71 when the tool is in rearward mode.

A plurality of rear radial holes 42 located forwardly of bearings 36 allow communication between recess 33 and an annular space 43 between striker 12 and body 11 bounded by seal rings 34, 36. A second set of front radial holes 44 allow communication between space 43 and front recess 32. Annular space 43, holes 44, front recess 32 and the interior space of body 11 ahead of bearings 34 together comprise the front, variable-volume pressure chamber 35 of the tool.

A front end portion 12A of striker 12 has a smaller maximum (outer) diameter than a rear end portion thereof 12C. A tapered midportion 12B having a maximum diameter smaller than that of rear portion 12C spans portions 12A and 12C. Midportion 12B may have a diameter over part of its length smaller than the maximum diameter of front portion 12A in order to further reduce stress on the striker. Front portion 12A includes air holes 44, recess 32 and bearings 34, which bearings are in sliding, sealing contact with the inner surface of front section 11A of tool body 11. Similarly, rear portion 12C includes holes 42, passages 33 and bearings 36, which bearings are in sliding, sealing contact with the inner surface of rear section 11C of tool body 11.

The difference in outer diameter between front and rear sections 11A and 11C of tool body 11 may, for example, be no more than about 0.5 inch. Preferably, the outer diameter (M) of front body section 11A is determined by the equation:

$$M = \sqrt{KD^2}$$

wherein D is the outer diameter of rear body section 11B, and K is a constant which may vary between about 0.5 and 0.9. If K exceeds about 0.9, the weight reduction of the tool becomes too small to be worthwhile, whereas if K is less than about 0.5, the stress on the striker becomes excessive, that is, the diameter of the front end of the striker becomes so small that the striker is likely to fracture during use. Hence, for a 4-inch tool, rear section 11C has a diameter of 4 inches and front section 11A has a diameter of about 3.5 inches.

The length of front section 11A must be sufficient to provide significant weight reduction. For this purpose, the reduced diameter portion of the body (section 11A) should comprise from at least about one-fifth, typically one-quarter to one-half of the overall body length, including nose 22 but exclusive of end cap 72 and the forwardly protruding part of anvil 23. The rear section must be long enough to house the internal part of tail assembly 14, stepped air inlet conduit 13, and the associated parts of rear striker section 12C. As an alternative to the illustrated embodiment, section 11A could be merged with either or both of nose 22 or midsection 11B to provide a gradual taper over the length of section 11A. However, this would require more exact machining and provide no functional advantages over the dual-diameter design illustrated wherein the front and rear sections 11A and 11C have essentially uniform outer diameters and the midsection lib occupies only a small fraction, e.g. one-tenth (10%) or less, preferably one-twentieth (5%) or less, of the entire length of the tool body 11 as defined above. Providing front section 11A with a constant outer diameter also makes the tool easier to launch.

Since bearings 34, 36 engage the inner surfaces of body sections 11A, 11C over a range of positions, the inner diameters of sections 11A, 11C must be substantially constant over the full range of positions, including positions adjusted for reverse operation, if provided for. Accordingly, if body section 11A has a gradual taper as discussed above, the thickness of body 11 would vary in section 11A. This would result in thin spots in the body wall at which the body would be more likely to fracture.

Conventional 4 inch diameter tools weigh from 137–140 pounds, but the illustrated tool in a 4 inch size for rear section 11C can weigh from 99 to 104 pounds. Such a weight reduction makes the tool liftable by one person and thus greatly reduces the chance of a lifting injury.

Performance of the tool can also be enhanced. In essence, the tool becomes more powerful because it has reduced weight but the same size air valve as provided for a standard tool wherein the body has a constant diameter along its length, other than at the nose located ahead of where the striker makes its forward impact. The energy transfer between striker and body becomes more efficient as the ratio of striker mass divided by non-striker tool mass increases.

A tool according to the invention provides various advantages over a short-bodied tool. In a short tool the tool mass is less, but the reduction in length leads to several disadvantages. A short mole is more easily deviated from its path during operation, increasing the risk of loosing the tool. Short moles are also less powerful because the ratio of striker mass divided by non-striker tool mass is relatively low. A short bodied tool could be provided with a long nose to improve boring accuracy, but such a tool would again have a low ratio of striker mass divided by non-striker tool mass, and would be heavier due to the extended nose. The nose and tailpiece are heavy, but provide no additional power and are independent of overall tool length.

The present invention provides a larger body diameter and valve bore only where necessary, that is, at the part of the air distributing mechanism wherein the stepped conduit 13 is inserted into the rear recess 33. The cross-sectional area of recess 33, and hence of rear portion 12C of the striker 12, determines the amount of surface against which the compressed air acts and hence determines the force behind the forward stroke. Accordingly, according to a preferred embodiment of the invention, sections 11A, 11B and portions 12A, 12B are each located ahead of the front end of stepped air inlet conduit 13, and preferably ahead of the front end wall 40 of recess 33.

According to a preferred form of the invention, body 11 is preferably made by a swaging process as described in Wentworth et al. U.S. Pat. No. 5,199,151, issued Apr. 6, 1993, the contents of which are incorporated by reference herein, followed by a machining step which cuts away material from the front of body 11 to form reduced diameter front body section 11A. Similarly, the inner surface of the body is machined rearwardly of midsection 11B to form the enlarged diameter portion of the internal chamber that houses rear portion 12C of striker 12.

The foregoing description is of preferred embodiments of the invention, and the invention is not limited to the specific forms shown. Modifications may be made in without departing from the scope of the invention as expressed in the appended claims.

We claim:

1. A pneumatic ground piercing tool, comprising:

an elongated hollow body having a front nose and a rear opening;

a striker disposed for reciprocation within an internal chamber of the body to impart impacts thereto for driving the body through the ground, the striker having a rearwardly opening recess and a rear radial passage through a wall enclosing the recess, a front portion having a front bearing thereon for sliding contact with a first inner surface of the body and passages permitting flow of pressure fluid to a front, variable-volume pressure chamber ahead of the striker, and a rear portion having a rear bearing thereon rearwardly of the radial passage for sliding contact with a second inner surface the body;

a stepped air inlet conduit which cooperates with the striker within the internal chamber of the body to reciprocate the striker and impart blows to a front end wall of the internal chamber under the action of a pressure fluid fed into the rear recess in the striker, followed by reverse movement of the striker when the rear radial passage moves past a front edge of the step of the stepped air inlet conduit, and exhaust of compressed air when the rear radial passage moves past a rear edge of the step of the stepped air inlet conduit; and a tail assembly mounted in the rear opening of the body that secures the striker and air inlet conduit in the body;

wherein the tubular body has a front section and a rear section having a greater inner diameter and greater outer diameter than the front section, the rear portion of the striker has a greater outer diameter than the front portion thereof, the front bearing remains in sliding contact with the first inner surface in the front section of the body during tool operation, and the rear bearing remains in sliding contact with the second inner surface in the rear section of the body during tool operation.

2. The tool of claim 1, wherein the front body section comprises at least about one-fifth of the total length of the tool body, the rear portion of the striker over at least a part of the length thereof radially outwardly of the rearwardly opening recess has a diameter greater than the maximum diameter of the front portion of the striker, the difference therebetween being approximately the same as the difference between the outer diameter of the rear body section and the outer diameter of the front body section, and each of the front and rear body sections have substantially uniform inner diameters over respective ranges of positions at which the front and rear bearings engage the first and second inner surfaces within the internal chamber.

3. The tool of claim 2, wherein the front body section comprises from about one-quarter to one-half of the total length of the tool body, and the outer diameter (M) of front body section is determined by the equation:

$$M = \sqrt{KD^2}$$

wherein D is the outer diameter of the rear body section, and K is a constant which may vary between about 0.5 and 0.9.

4. The tool of claim 3, wherein the outer diameter of the rear section of the tool body is in the range of from about 2 to 6 inches, and the thickness of the tool body is in the range of 0.2 to 0.8 inch.

5. The tool of claim 4, wherein the front and rear sections have substantially the same thickness, and a midsection interposed between the front and rear body sections has a greater thickness than the front and rear body sections, which midsection has a length of about one-tenth or less of the total length of the tool body.

6. The tool of claim 2, wherein the each of the front and rear body sections have substantially uniform inner diameters over the lengths thereof.

7. The tool of claim 6, wherein the each of the front and rear body sections have substantially uniform outer diameters over the lengths thereof.

8. The tool of claim 5, wherein the each of the front and rear body sections have substantially uniform inner and outer diameters over the lengths thereof.

9. The tool of claim 5, wherein the midsection has a thickness at least 50% greater than the front and rear body sections.

10. The tool of claim 2, wherein the tool body further comprises a forwardly tapering nose ahead of the front body section.

11. The tool of claim 10, wherein the tool body further comprises an anvil mounted in the nose, such that the striker impacts against a rear end surface of the anvil.

12. The tool of claim 2, wherein the tool body further comprises a midsection between the front body section and the rear body section, the midsection having a forwardly tapering outer surface.

13. The tool of claim 12, wherein the forwardly tapering midsection comprises one-tenth or less of the total length of the tool body.

14. The tool of claim 1, wherein the tool further comprises a reversing mechanism that changes the position of the stepped air inlet conduit relative to the striker so that the striker ceases to impact against a front end wall of the internal chamber and impacts against a tail nut threadedly coupled in the rear opening of the rear body section.

15. The tool of claim 1, wherein the passages permitting flow of pressure fluid to a front, variable-volume pressure chamber further comprise a frontwardly opening central recess in the striker and a front radial passage in communication therewith, which front radial passage opens rearwardly of the front bearing in the front portion of the striker.

16. The tool of claim 4, wherein the striker and tool body are each made of steel.

* * * * *